United States Patent [19]

Sundin

[11] Patent Number: 4,580,377

[45] Date of Patent: Apr. 8, 1986

[54] TELESCOPIC MAST

[76] Inventor: Erik Sundin, Rissnestigen 4, S-172 37 Sundbyberg, Sweden

[21] Appl. No.: 638,456

[22] PCT Filed: Dec. 15, 1983

[86] PCT No.: PCT/SE83/00459

§ 371 Date: Aug. 1, 1984

§ 102(e) Date: Aug. 1, 1984

[87] PCT Pub. No.: WO84/02554

PCT Pub. Date: Jul. 5, 1984

[30] Foreign Application Priority Data

Dec. 23, 1982 [SE] Sweden ..... 8207393

[51] Int. Cl.[4] ..... E04H 12/18; E04H 12/34

[52] U.S. Cl. ..... 52/121; 52/111; 254/400

[58] Field of Search ..... 52/111, 116, 117, 118, 52/121; 254/387, 395, 399, 400

[56] References Cited

U.S. PATENT DOCUMENTS

| | | | |
|---|---|---|---|
| 1,319,943 | 10/1919 | Bessolo | 52/121 X |
| 1,400,435 | 12/1921 | Heil | 254/400 |
| 2,006,388 | 7/1935 | Ellis | 254/400 |
| 2,508,835 | 5/1950 | Moon et al. | 52/118 X |
| 2,795,303 | 6/1957 | Muehlhause et al. | 52/121 |
| 2,800,206 | 7/1957 | Thorpe | 52/118 |
| 2,983,474 | 5/1961 | Hanna | 254/387 X |
| 3,328,921 | 7/1967 | Keslin | 52/121 |
| 3,952,467 | 4/1976 | Partlow | 52/121 |

FOREIGN PATENT DOCUMENTS

| | | | |
|---|---|---|---|
| 525774 | 6/1956 | Canada | 254/400 |
| 272491 | 9/1913 | Fed. Rep. of Germany . | |
| 59829 | 9/1938 | Norway . | |
| 07505-7 | 3/1981 | Sweden . | |
| 10330 | of 1906 | United Kingdom | 52/121 |
| 212067 | 3/1924 | United Kingdom | 52/121 |

*Primary Examiner*—Stuart S. Levy
*Assistant Examiner*—Daniel P. Stodola
*Attorney, Agent, or Firm*—Sughrue, Mion, Zinn, Macpeak and Seas

[57] ABSTRACT

A telescopic mast comprises a plurality of mast sections (2, 3, 4) which can be displaced axially relative to one another while guided by each other. The sections are arranged to be moved out of one another by means of a continuous line (13), which passes and co-acts with all mast sections, from the outermost to the innermost section. Each mast section (2, 3, 4) includes at least one lower line-guide pulley (5, 6, 7) and one line-returning unit (8, 9, 10) arranged at the upper end of a respective section. That part of the line (18) extending between the pulley (5) and the line-returning unit (8) of one section (2) and between said line-returning unit (8) and the guide pulley (6) of the nearest inwardly lying section (3) is fully protected in a space located between the sections (2, 3). The sections suitably comprise open-ended, closed-wall cylinders (2, 3, 4) arranged to fit within one another with a small clearance therebetween and which enable the mast to be used in the absence of guys.

6 Claims, 6 Drawing Figures

TELESCOPIC MAST

TECHNICAL FIELD

The present invention relates to a telescopic mast which includes a plurality of mast sections which can be displaced relative to one another while guiding each other, and which are arranged to be extended one from the other with the aid of a single continuous line which passes along and co-acts with all said sections, from the innermost section to the outermost section.

BACKGROUND ART

Such telescopic masts, which are primarily intended for temporary use, have a very wide range of use. They are used, inter alia, as aerial masts by the armed forces, by Telecommunications Administrations, and by Television Companies. They are also used as standards for electric lighting equipment, measuring and control equipment, and the like. Consequently, it must be possible to transport and erect the masts in a relatively easy fashion.

Most of the masts used today need to be guyed or otherwise stiffened when erected, which renders it more difficult to erect the mast and greatly extends the time required herefor. The lines of known masts lie outside the mast and are hence unprotected and liable to be damaged by the rough treatment to which such masts are subjected. In addition hereto, the unprotected, externally located lines are also liable to pick-up dirt and other foreign matter and to carry the same into the mast interior, which can readily impair the telescopic function of the mast. Furthermore, the type of mast most used today includes a plurality of separate lines, which; among other things, makes line changes extremely expensive, since such changes make it necessary to dismantle the mast sections completely.

Another disadvantage with most of the known masts is that the mast sections are not lifted from the centre of the mast, and hence the sections are liable to jam and become stuck.

OBJECT OF THE INVENTION

A prime object of the invention is to provide a telescopic mast of the aforementioned kind with which, inter alia, the aforementioned disadvantages are eliminated. Thus, it shall not be necessary to guy the mast, and it shall be possible to extend and collapse the mast with the aid of a single, readily replaceable line which extends fully protected within the mast.

BRIEF SUMMARY OF THE INVENTION

To this end, each of the mast sections of a mast constructed in accordance with the invention is provided at the bottom thereof with at least one lower line-guide pulley and at the top thereof with at least one line-returning means, and the line portion located between the guide pulley and the line-returning means of one mast section and between said line-returning means and the guide pulley of the nearest inwardly lying mast section extends fully protected in a space located between said sections. In this way, the line remains totally encased within the mast, so that no part of said line lies exposed, and hence the line is guarded against possible damage from outside forces. In addition, an old line can be readily changed for a new line, by simply attaching the new line to the old one, and drawing it through the mast structure.

The line-returning means of each mast section is suitably connected with and located partially outside its respective section. The line-returning means conveniently comprises two line pulleys which are arranged substantially vertically at an angle to one another and which are arranged to guide the line towards and away from a further pulley which extends substantially horizontally and which lies above said vertical pulleys. In this respect, the two vertical line pulleys project inwardly through an opening in the wall of an associated mast section.

In a preferred embodiment, the lower line-guide pulley of each section is arranged substantially centrally in the lower part of said mast section, which, among other things, prevents jamming of the sections. In this respect, the diameter of the guide pulley corresponds substantially to the internal measurements of its respective section, said pulley being arranged to project through an opening formed in the wall of said section.

Preferably, the mast sections consist of open-ended, closed-wall hollow cylinders, arranged to fit one within the other with a small clearance therebetween, while an upper and a lower slot are arranged in the wall of each mast section, for accommodating the line-guiding pulleys and the line-returning means, respectively. This enables a fully closed and totally self-supporting mast to be constructed. Suitably, the cross-sectional shape of respective cylinders is such as to prevent the cylinders rotating relative to one another, and each cylindrical mast section has pressed therein an elongate channel or the like forming a passage for the line.

In order to obtain full control over respective mast sections when extending the same, the mast is suitably provided with operable latching means, which enable selected mast sections to be locked one to the other.

In a preferred embodiment of the invention, each mast section is provided at its upper end with attachment means for mounting lattice-work sections, which when the mast is extended can be mutually secured together to form a mast of lattice structure.

The invention will now be described in more detail with reference to an embodiment thereof illustrated in the accompanying drawings.

DESCRIPTION OF A PREFERRED EMBODIMENT OF THE INVENTION

Figure 1:
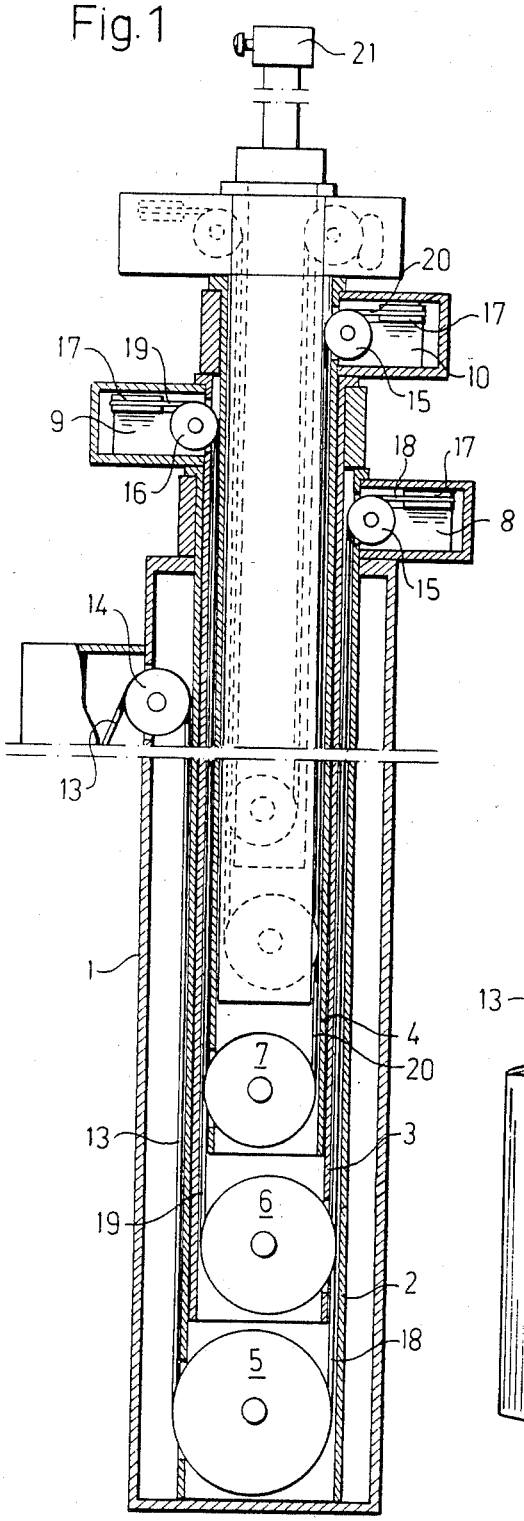
FIG. 1 is a cross-sectional view of a mast according to the invention, in a collapsed state.

The mast illustrated in FIG. 1 includes a cylindrical base 1, which is intended to be mounted on a support structure, or on a vehicle or the like. In the collapsed state of the mast, illustrated in FIG. 1, i.e. the mast transporting state, a plurality of mast sections, of which the three outermost sections are referenced 2, 3 and 4, are collapsed one within the other and in the base 1. Arranged in the lower part of each mast section is a first line-guide means in the form of a respective rotatable pulley 5, 6 and 7. Fixedly mounted at the upper end of respective mast sections is an encapsulated second line-guide arrangement in the form of a line-returning means 8, 9 and 10.

Figure 1B:
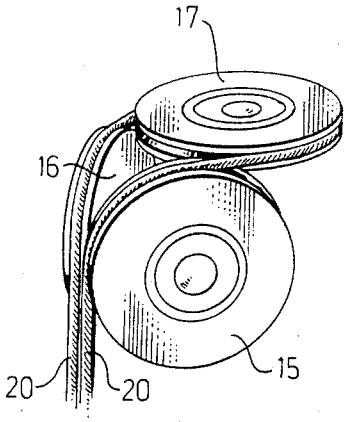
FIG. 1B illustrates the construction of a line-returning means according to the invention.
Figure 1A:
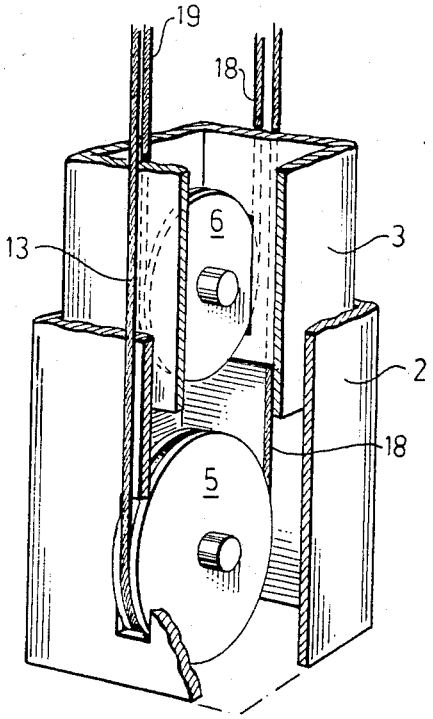
FIG. 1A is a perspective view, partially cut away, of the lower part of the mast illustrated in FIG. 1.

As will be seen from FIG. 1A, the mast sections suitably have the form of open-ended cylinders of rectangular cross-section, said sections fitting one within the other with a small clearance therebetween. The cylinders may be extruded from aluminium or the like.

For the purpose of displacing respective sections out from one another, there is provided a single continuous line 13, which is driven by a motor-driven cable drum (not shown), arranged to co-act with all mast sections, from the outermost to the innermost section. The line 13 passes into the base 1 over a pulley or the like 14 arranged in the wall thereof.

The line-guide pulley of each mast section is arranged to project slightly through a slot formed in one wall of a respective mast section, the line-guide pulleys of mast sections located inwardly of one another projecting out through corresponding walls of respective sections.

As will be seen from FIG. 1B each line-returning means comprises a pulley arrangement in which two substantially vertically arranged pulleys 15 and 16 are placed at an angle to one another and arranged to guide the line towards and away from a further, line-returning pulley 17 located above said pulleys 15 and 16. As shown in FIG. 1, the unit comprising the pulleys 15–17 is arranged in a housing which is fixedly mounted on respective sections, with the pulleys 15 and 16 projecting inwardly through a slot-like opening in the wall of an associated section. Similarly to the line-guide pulleys, the line-returning means in sections located inwardly of one another are arranged on mutually opposite surfaces of said sections.

As will also be seen from FIG. 1, the line 13 passes from the line-guide pulley 14 down to the line-guide pulley 5 of the outermost mast section. The line, which is here referenced 18, passes from the pulley 5 to the line-returning means 8 of the outermost section 2, where the line is turned to extend down to the line-pulley 6 of the nearest, radially inwardly lying section 3. The parts of the line 18 lying between the pulley 5 and the line-returning means 8, and between said line-returning means and the pulley 6 are fully protected within a space located between the mast sections 2 and 3. The line, here referenced 19, extends from the pulley 6 up to the line-returning means 9 of the section 3, where the line is turned to extend down to the line-guide pulley 7 of the inwardly lying section 4. Thus, the line part 19 extends fully protected between the sections 3 and 4. Correspondingly, the line, here referenced 20, extends from the line-guide pulley 7 up to the line-returning means 10, and back down to the line-guide pulley of the inwardly lying section, and so on. The terminal end of the line is fastened to the innermost section.

Figure 4:
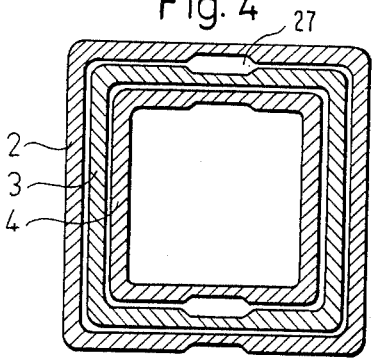
FIG. 4 illustrates a cross-section through three mast sections provided with line receiving grooves.

In order to provide room for the line portions extending between the closely fitting mast sections there is pressed into a side surface of each of said sections an elongate groove or like channel 27 as illustrated in FIG. 4.

The mast is extended by drawing on the line 13, which causes the mast sections to be lifted out of one another. Since each of the mast sections rests on the line via associated lower line-guide pulleys, which are located substantially centrally in respective sections, said sections will be moved out of each other with the minimum of friction, and without jamming one within the other. If no latching devices are used, when the mast is extended those sections which are easiest to move will extend first, these sections normally being the innermost sections. By using latching means to selectively lock the various sections one to the other, it is possible to extend the various mast sections in a selected sequence. Such latching means, which may have the form of simple locking pins, are suitably electro-magnetically actuable, to permit remote control from ground level. The latching means may also be automatically actuable, in dependence upon the mutual positions of the sections.

Because of the manner in which the different sections fit one within the other, it is possible to erect a mast according to the invention without requiring to guy the mast or to support it in any other way, which greatly simplifies and shortens the assembly work. The mast can also be provided with suitable attachment means, such as means 21, for attaching desired equipment to said mast.

Since the line in a mast constructed according to the invention is fully protected, it will not be damaged by external forces. The line can be readily replaced, in the manner mentioned in the introduction.

When the mast comprises the cylindrical sections illustrated in FIG. 1A, the mast can be totally sealed, by providing respective telescopic mast sections at their upper openings with a sealing element which co-acts with the nearest, inwardly lying section. Any foreign matter entering the mast is able to fall down therethrough, without disturbing the telescopic function of the mast.

Figure 3:
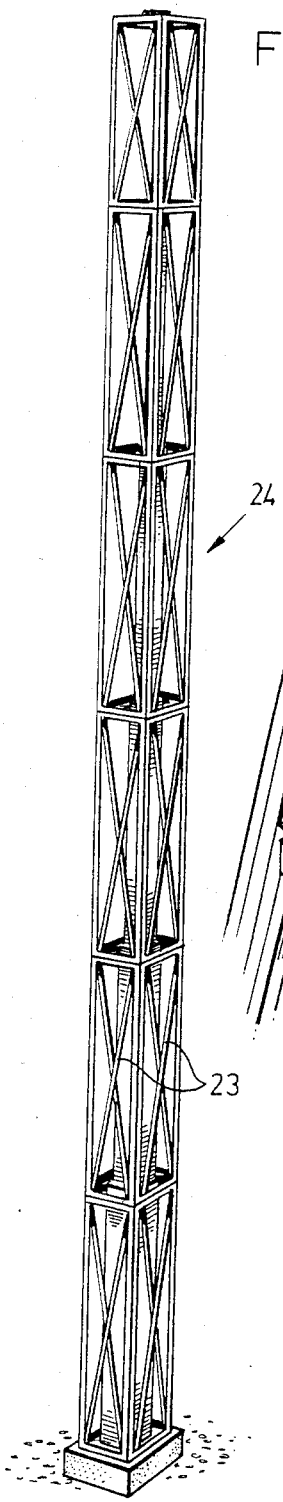
FIG. 3 illustrates a mast according to the invention with a lattice mast-structure mounted thereon.
Figure 2:
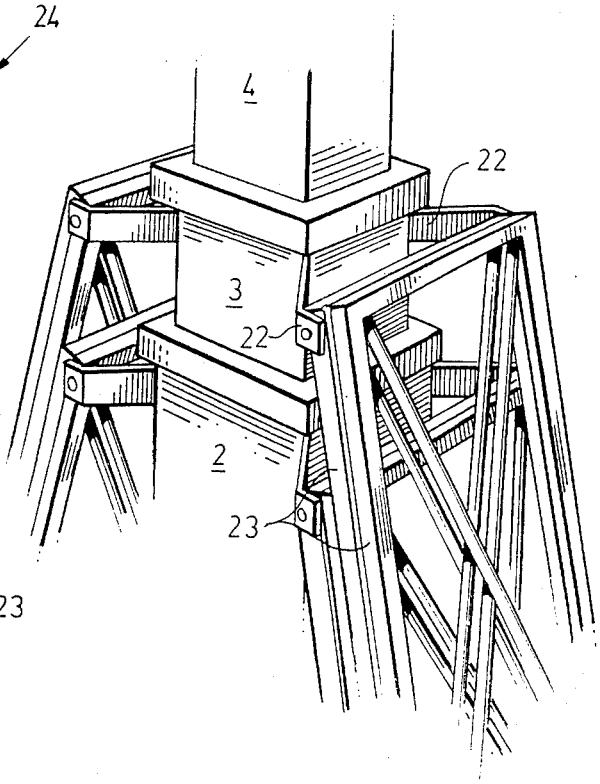
FIG. 2 illustrates the lower part of the mast in the initial stage of extending the mast, this figure also showing lattice sections mounted on said mast.

Since the mast does not require guying, it is also suitable for use, among other things, as a lifting and assembly mast for lattice masts intended for permanent use. As shown in FIG. 2, there is provided, to this end, at the upper part of each mast section an attachment means 22 to which sections of a lattice mast and having the form of gates 23 can be pivotably mounted. Each mast section is suitably provided with such attachment means 22 on two mutually opposite sides thereof, two lattice gates 23 being mounted on each pair of attachments, said gates being able to pivot relative to one another about vertical hinges when the mast is extended. A lattice mast 24 of the kind illustrated in FIG. 3 can be readily constructed, by extending the telescopic mast sections one after the other, and successively locking the lattice gates together.

In the aforegoing, the invention has been described with reference to a preferred embodiment of a mast according to the invention. The illustrated mast can be modified, however, in several respects within the scope of the invention. For example, the mast may comprise a different number of sections to that illustrated, and the design of said sections can be varied as desired. Thus, the sections need not comprise cylinders having imperforate walls, but may comprise lattice structures or the like, for example. The sections can also be extended by drawing the line 13 from its upper end, instead of its lower end. The line-returning means can have any desired configuration, while retaining its intended function. Similarly, when the mast sections have large diameters, the lower line-guide pulley can be replaced with two smaller pulleys located on mutually opposite side surfaces of respective sections, of which pulleys one receives the line from the outside while the other guides the line up through its respective section. Suitably, the arrangement may also be such as to permit the mast sections to be turned in the base, to permit desired orientation of objects supported by the mast.

I claim:

1. A telescopic mast comprising a plurality of mast sections (2, 3, 4) axially displaceable relative to one another, said mast sections being positioned to guide each other as they are extended one from the other by a single continuous line (13) which passes along and co-acts with said mast sections from an innermost section to an outermost section, each of said plurality of mast sections including at least one lower line-guide pulley (5, 6, 7) arranged at one end of its respective section and one line-returning means (8, 9, 10) arranged at the other end of and at least partially exterior to its respective section, said single continuous line passing around said at least one lower line-guide pulley of each of said plurality of mast sections and upwardly therefrom through the interior of its respective mast section to the line-returning means of that same mast section, and then downwardly from said line-returning means of the same mast section through a space between said mast section and the nearest inwardly adjacent mast section to the at least one lower line-guide pulley of said next inwardly adjacent mast section so that the single continuous line between the at least one guide pulley and the line-returning means of one of said plurality of mast sections and between the line-returning means of said one of said plurality of mast sections and the at least one line-guide pulley of the nearest inwardly adjacent mast section extends fully protected in a space between said one of said pluralty of mast sections and its nearest inwardly adjacent mast section, said space being defined by an elongate groove (27) in at least one of said adjacent mast sections, and wherein each of said line returning means (8, 9, 10) includes two substantially vertically arranged pulleys (15, 16) placed at an angle to one another and a substantially horizontally placed pulley (17) located above said vertical pulleys, said vertically arranged pulleys being arranged to guide the continuous line (13) toward and away from said substantially horizontally placed pulley.

2. A mast according to claim 1, characterized in that each of said plurality of mast sections includes an opening in a wall thereof, said two vertically placed pulleys (15, 16) of the respective line-returning means projecting through said wall opening.

3. A mast according to claim 1, characterized in that the at least one line-guiding pulley (5; 6; 7) of each of said plurality of mast sections is arranged substantially in the centre of the lower part of its respective section.

4. A mast according to claim 3, characterized in that the diameter of each of the line-guiding pulleys (5; 6; 7) corresponds substantially to the internal measurements of an associated section; each of said plurality of mast sections having an opening in a wall thereof, each of the at least one line-guiding pulleys projecting through said opening in the wall of its associated mast section.

5. A mast according to claim 1, characterized in that the mast sections comprise open-ended, closed-wall cylinders (2; 3; 4) which fit within one another with a small clearance therebetween and in which a lower and an upper lead-in slot is arranged opposite the line-guiding pulleys (5; 6; 7) and the line-returning means (8; 9; 10), respectively.

6. A mast according to claim 1, characterized in that each mast section (2; 3; 4) is provided at its upper end with attachment means (22) for mounting lattice sections (23), which can be mutually connected together when extending the telescopic mast, to form a lattice mast (24).

* * * * *